US011390050B2

(12) United States Patent
Aoki et al.

(10) Patent No.: US 11,390,050 B2
(45) Date of Patent: Jul. 19, 2022

(54) SHEET DRYING DEVICE AND METHOD, AND BOX MAKING MACHINE

(71) Applicant: MITSUBISHI HEAVY INDUSTRIES MACHINERY SYSTEMS, LTD., Hyogo (JP)

(72) Inventors: Shoichi Aoki, Tokyo (JP); Kengo Yamaguchi, Tokyo (JP); Osamu Yamamoto, Hiroshima (JP); Kazuya Sugimoto, Hiroshima (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 261 days.

(21) Appl. No.: 16/481,486

(22) PCT Filed: Dec. 25, 2017

(86) PCT No.: PCT/JP2017/046305
§ 371 (c)(1),
(2) Date: Jul. 29, 2019

(87) PCT Pub. No.: WO2018/146960
PCT Pub. Date: Aug. 16, 2018

(65) Prior Publication Data

US 2020/0023605 A1 Jan. 23, 2020

(30) Foreign Application Priority Data

Feb. 13, 2017 (JP) ..... JP2017-024079

(51) Int. Cl.
*B31B 50/25* (2017.01)
*B31B 50/26* (2017.01)
(Continued)

(52) U.S. Cl.
CPC ..... *B31B 50/25* (2017.08); *B31B 50/26* (2017.08); *B31B 50/88* (2017.08); *B31B 50/98* (2017.08); *B41F 23/045* (2013.01); *F26B 25/22* (2013.01)

(58) Field of Classification Search
CPC ..... B41F 23/0466; B41F 23/045; B41F 23/0456; F26B 25/00; F26B 25/22; F26B 3/30; B31B 50/88
See application file for complete search history.

(56) References Cited

U.S. PATENT DOCUMENTS 4,756,091 A * 7/1988 Van Denend ..... A43D 25/20 219/388
4,882,852 A * 11/1989 Kautto ..... F26B 23/001 34/273
(Continued)

FOREIGN PATENT DOCUMENTS

CN 1849492 A 10/2006
CN 103269849 A 8/2013
(Continued)

OTHER PUBLICATIONS

Office Action for Japanese Application No. 2017-024079 dated Oct. 27, 2020; 7pp.
(Continued)

*Primary Examiner* — Andrew M Tecco
*Assistant Examiner* — Nicholas E Igbokwe
(74) *Attorney, Agent, or Firm* — Hauptman Ham, LLP

(57) ABSTRACT

A sheet drying device and method, and a box making machine, wherein provided are: a heating lamp (111) that is disposed facing a printing face of a cardboard sheet (S); a voltage adjusting unit (122) that adjusts the voltage of electrical power supplied to the heating lamp (111); a voltage setting unit (121) that sets the working voltage of the heating lamp (111) by increasing or decreasing a reference
(Continued)

voltage according to the thickness of a water-based paint on the cardboard sheet (S), where the reference voltage is a voltage that is less than the rated voltage of the heating lamp (111) by a preset prescribed value; and a controlling device (101) that changes the voltage of the heating lamp (111) to the working voltage set by the voltage setting unit (121) using the voltage adjusting unit (122).

9 Claims, 6 Drawing Sheets

(51) Int. Cl.

| | |
|---|---|
| *B31B 50/98* | (2017.01) |
| *B31B 50/88* | (2017.01) |
| *B41F 23/04* | (2006.01) |
| *F26B 25/22* | (2006.01) |

(56) References Cited

U.S. PATENT DOCUMENTS

| | | | | |
|---|---|---|---|---|
| 5,537,925 | A * | 7/1996 | Secor | F26B 3/283 101/424.1 |
| 5,937,761 | A * | 8/1999 | Buschmann | B41F 23/04 101/424.1 |
| 6,877,247 | B1 * | 4/2005 | DeMoore | F26B 3/283 34/269 |
| 2007/0011906 | A1 | 1/2007 | Morita | |
| 2013/0184133 | A1 | 7/2013 | Sugimoto et al. | |
| 2014/0090267 | A1 * | 4/2014 | Walker | F26B 13/10 34/282 |
| 2017/0066254 | A1 * | 3/2017 | Inoue | H05B 6/60 |

FOREIGN PATENT DOCUMENTS

| | | | | | |
|---|---|---|---|---|---|
| EP | 2213449 | A1 | | 8/2010 | |
| EP | 2623328 | A1 | | 8/2013 | |
| JP | S60175358 | A | * | 2/1984 | H01K 1/62 |
| JP | 60076346 | A | | 4/1985 | |
| JP | S60175358 | A | | 9/1985 | |
| JP | H01501073 | A | | 4/1989 | |
| JP | H01130938 | A | | 5/1989 | |
| JP | H01135646 | A | | 5/1989 | |
| JP | 05138771 | A | | 6/1993 | |
| JP | H09199283 | A | | 7/1997 | |
| JP | 2004506553 | A | | 3/2004 | |
| JP | 2005083630 | A | | 3/2005 | |
| JP | 2012076334 | A | | 4/2012 | |
| JP | 2013073071 | A | | 4/2013 | |
| JP | 2014069367 | A | | 4/2014 | |
| JP | 5760907 | B2 | | 8/2015 | |
| WO | 0216139 | A1 | | 2/2002 | |

OTHER PUBLICATIONS

Chinese Office Action for Application No. 201780084317.X dated May 20, 2020; 22pp.

Office Action for Japanese Application No. 2017-024079 dated Jun. 2, 2020; 7pp.

International Search Report and Written Opinion for International Application No. PCT/JP2017/046305 dated Feb. 13, 2018; 16pp.

Office Action for Japanese Application No. 2017-024079 dated Oct. 22, 2020; 7pp.

Extended European Search Report for European Application No. 17895785.8 dated Dec. 5, 2019; 9pp.

* cited by examiner

| | ELECTRIC POWER DENSITY | COLOR TEMPERATURE | MAIN WAVELENGTH | MOISTURE ABSORPTION RATE @15 μm | MOISTURE HEAT INPUT | LAMP LIFE MAGNIFICATION |
|---|---|---|---|---|---|---|
| CONVENTIONAL | 70kW/m$^2$ | 2500K | 1.1 μm | 13.3% | 9.3kW/m$^2$ | 1 |
| PRESENT EMBODIMENT | 50kW/m$^2$ | 2250K | 1.3 μm | 16.4% | 8.2kW/m$^2$ | 4 |

SHEET DRYING DEVICE AND METHOD, AND BOX MAKING MACHINE

RELATED APPLICATIONS

The present application is a National Phase of International Application Number PCT/JP2017/046305 filed Dec. 25, 2017 and claims priority to Japanese Application Number 2017-024079 filed Feb. 13, 2017.

TECHNICAL FIELD

The present invention relates to sheet drying device and method of drying a sheet such as a printed corrugated fiberboard or a printed sheet, and a box making machine provided with the sheet drying device.

BACKGROUND ART

For example, a general box making machine makes a box body (a corrugated box) by processing a sheet material (for example, a corrugated fiberboard) and is composed of a sheet feeding section, a printing section, a slotter creaser section, a die-cut section, a folding section (a folder gluer), and a counter-ejector section. In this box making machine, after printing is performed on the corrugated fiberboard in the printing section, in the slotter creaser section, creasing lines are formed in the printed corrugated fiberboard and grooving processing or gluing margin strip processing is performed on the printed corrugated fiberboard, and then, in the die-cut section, punching processing is carried out.

At this time, if drying of ink applied to the surface of the corrugated fiberboard by the printing is insufficient, the ink is rubbed by a knife at the time of the punching processing in the die-cut section, and thus a printing failure occurs. Further, at this time, the ink or the like sticks to the knife of the die-cut section, and thus, at the time of the punching processing of the next corrugated fiberboard, there is a concern that the corrugated fiberboard may be stained with the ink. Therefore, it has been considered to provide a drying device downstream of the printing section in the box making machine to dry the ink applied to the corrugated fiberboard. As the drying device of the box making machine, for example, there is a drying device disclosed in PTL 1 below.

CITATION LIST

Patent Literature

[PTL 1] Japanese Unexamined Patent Application Publication No. 05-138771

SUMMARY OF INVENTION

Technical Problem

In the printing drying device of the box making machine disclosed in PTL 1 described above, when the corrugated fiberboard travels from a printing unit to a printing ink drying unit, a pattern on the corrugated fiberboard is detected by a pattern detection sensor, and only a printing ink drying unit corresponding thereto is operated, whereby energy saving is achieved. In this case, the ink is dried by supplying hot air only to an area where the pattern is detected. However, the printing section is generally made to be capable of performing multi-color printing, and the amount of heat required for drying differs between a single-color printed area and a multi-color printed area, and thus sufficient energy saving cannot be achieved only by turning on and off hot air supply.

The present invention is for solving the problem described above and has an object to provide sheet drying device and method, and a box making machine, in which energy saving and prolongation of the life of a heating lamp are achieved.

Solution to Problem

A sheet drying device according to the present invention for achieving the above object is a sheet drying device that dries water-based paint on a sheet that is conveyed, and includes a heating lamp that is disposed to face a printing surface of the sheet, a voltage adjusting unit that adjusts a voltage of electric power to be supplied to the heating lamp, a voltage setting unit that sets a working voltage of the heating lamp by setting a voltage that is lower than a rated voltage of the heating lamp by a predetermined value set in advance as a reference voltage and increasing or decreasing the reference voltage according to an application amount of the water-based paint on the sheet, and a control unit that changes a voltage of the heating lamp to the working voltage set by the voltage setting unit by using the voltage adjusting unit.

Therefore, the working voltage of the heating lamp is set by setting a voltage lower than the rated voltage of the heating lamp as a reference voltage and increasing or decreasing the reference voltage according to the application amount of the water-based paint on the sheet, and the set working voltage is applied to the heating lamp to light the heating lamp, whereby the water-based paint on the sheet is dried. For this reason, the water-based paint is dried with the minimum amount of energy, and thus energy saving of the heating lamp can be achieved while maintaining the drying performance of the water-based paint and prolongation of the life of the heating lamp can be achieved.

In the sheet drying device according to the present invention, the reference voltage is set to a voltage between 75% of the rated voltage of the heating lamp and 85% of the rated voltage of the heating lamp.

Therefore, since the reference voltage is set to a voltage between 75% of the rated voltage of the heating lamp and 85% of the rated voltage of the heating lamp, energy saving of the heating lamp can be achieved while maintaining the drying performance of the water-based paint and prolongation of the life of the heating lamp can be achieved.

In the sheet drying device according to the present invention, the water-based paint is water-based ink of at least one or more colors or water-based varnish, and the voltage setting unit sets the working voltage by increasing the reference voltage as an overlapping amount of the water-based paint increases.

Therefore, the working voltage is set by increasing the reference voltage as an overlapping amount of the water-based ink or the water-based varnish on the sheet increases, whereby even in an area where the water-based ink or the water-based varnish overlaps, sufficient drying performance can be secured.

In the sheet drying device according to the present invention, the voltage setting unit sets the working voltage by increasing or decreasing the reference voltage, based on print information.

Therefore, the working voltage is set by increasing or decreasing the reference voltage, based on print information, whereby the working voltage of the heating lamp according to a print pattern can be set, and drying unevenness can be suppressed.

In the sheet drying device according to the present invention, the voltage setting unit increases the working voltage as a conveying speed of the sheet as the print information increases.

Therefore, since the working voltage increases as the conveying speed of the sheet increases, insufficient drying due to an increase in the conveying speed of the sheet can be suppressed.

In the sheet drying device according to the present invention, a moisture sensor that measures the amount of moisture of the water-based paint on the sheet after drying is provided, and the voltage setting unit increases the working voltage when a measurement value of the moisture sensor is higher than a determination value set in advance.

Therefore, when the amount of moisture of the water-based paint on the sheet after drying is higher than the determination value, the working voltage is increased, whereby even if variation in drying of the water-based paint occurs, the working voltage is increased early to increase the heating amount, and therefore, stable drying performance can be maintained.

In the sheet drying device according to the present invention, the heating lamp includes a plurality of lamp bodies that extend in a transfer direction of the sheet and are disposed at predetermined intervals in a direction crossing the transfer direction of the sheet, and the voltage setting unit sets the working voltage for each of the plurality of lamp bodies according to the application amount of the water-based paint on the sheet.

Therefore, the working voltage is set for each of the plurality of lamp bodies according to the application amount of the water-based paint on the sheet, whereby even if the ink application amount changes in the width direction of the sheet, stable drying performance can be maintained.

Further, a sheet drying method according to the present invention is a sheet drying method of drying water-based paint on a sheet that is conveyed, by using a heating lamp that is disposed to face the water-based paint on the sheet, and includes a step of setting a voltage that is lower than a rated voltage of the heating lamp by a predetermined value set in advance as a reference voltage, and a step of setting a working voltage of the heating lamp by increasing or decreasing the reference voltage according to an application amount of the water-based paint on the sheet.

Therefore, energy saving of the heating lamp can be achieved while maintaining the drying performance of the water-based paint, and prolongation of the life of the heating lamp can be achieved.

Further, a sheet drying method according to the present invention is a sheet drying method of drying water-based paint on a sheet that is conveyed, by using a heating lamp that is disposed to face the water-based paint on the sheet, and includes a step of setting a rated voltage of the heating lamp according to a maximum application amount of the water-based paint on the sheet, and a step of adjusting the rated voltage according to the application amount in a range between the rated voltage and a voltage of 75% of the rated voltage when the application amount of the water-based paint on the sheet decreases below the maximum application amount.

Therefore, energy saving of the heating lamp can be achieved while maintaining the drying performance of the water-based paint, and prolongation of the life of the heating lamp can be achieved.

Further, a box making machine according to the present invention includes a sheet feeding section that supplies a corrugated fiberboard, a printing section that performs printing on the corrugated fiberboard, the sheet drying device that dries water-based paint on the printed corrugated fiberboard, a slotter creaser section that performs creasing line processing and grooving processing on the dried corrugated fiberboard, a folding section that makes a flat corrugated box by folding the corrugated fiberboard along creasing lines, and a counter-ejector section that discharges the flat corrugated boxes every predetermined number after stacking the flat corrugated boxes while counting the flat corrugated boxes.

Therefore, printing is performed on the corrugated fiberboard from the sheet feeding section in the printing section, the water-based paint on the corrugated fiberboard is dried in the sheet drying device, creasing line processing and grooving processing are performed in the slotter creaser section, punching processing is performed on the corrugated fiberboard by a rotary die-cutter, and in the folding section, folding is performed and the end portions are joined to each other, so that a box body is formed, and the box bodies are stacked while being counted in the counter-ejector section. At this time, in the sheet drying device, the water-based paint on the sheet is dried by setting a voltage lower than the rated voltage of the heating lamp as a reference voltage, setting the working voltage of the heating lamp by increasing or decreasing the reference voltage according to the application amount of the water-based paint on the sheet, and applying the set working voltage to the heating lamp to light the heating lamp. For this reason, energy saving of the heating lamp can be achieved while maintaining the drying performance of the water-based paint, and prolongation of the life of the heating lamp can be achieved.

Advantageous Effects of Invention

According to the sheet drying device and method, and the box making machine according to the present invention, since the working voltage of the heating lamp is set by setting a voltage lower than the rated voltage of the heating lamp as a reference voltage and increasing or decreasing the reference voltage according to the application amount of the water-based paint on the sheet, energy saving of the heating lamp can be achieved while maintaining the drying performance of the water-based paint and prolongation of the life of the heating lamp can be achieved.

DESCRIPTION OF EMBODIMENTS

Hereinafter, a preferred embodiment of sheet drying device and method and a box making machine according to the present invention will be described in detail with reference to the accompanying drawings. The present invention is not limited by this embodiment, and in a case where there are a plurality of embodiments, the present invention also includes configurations made by combining the respective embodiments.

Figure 1:
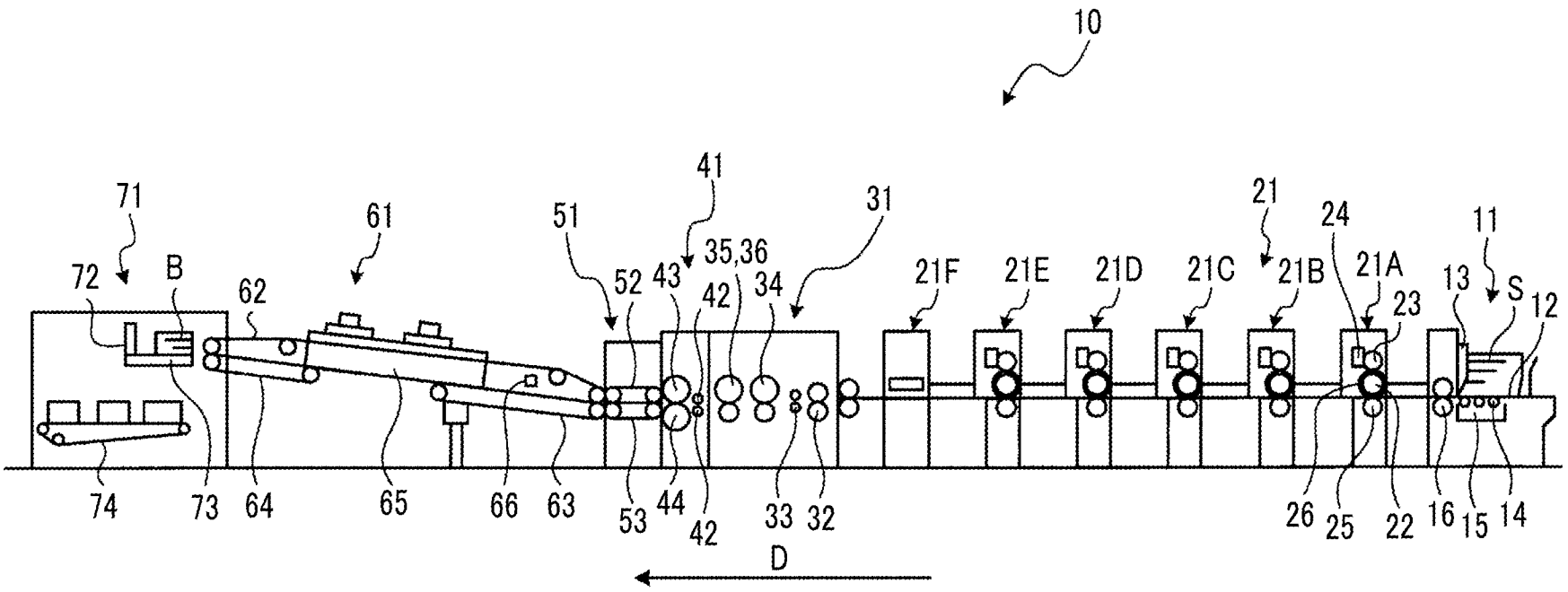
FIG. 1 is a schematic configuration diagram showing a box making machine of the present embodiment.

This embodiment will be described by applying the sheet drying device and method according to the present invention to a box making machine. FIG. 1 is a schematic configuration diagram showing a box making machine of this embodiment.

In this embodiment, as shown in FIG. 1, a box making machine 10 is for making a corrugated box (a box body) B by processing a corrugated fiberboard (a sheet) S. The box making machine 10 is configured to include a sheet feeding section 11, a printing section 21, a slotter creaser section 31, a die-cut section 41, a speed-increasing section 51, a folding section 61, and a counter-ejector section 71, which are disposed linearly in a transfer direction D in which the corrugated fiberboard S and the corrugated box B are conveyed.

The sheet feeding section 11 is for feeding the corrugated fiberboards S one by one to send them to the printing section 21 at a constant speed. The sheet feeding section 11 includes a table 12, a front stop 13, a feed roller 14, a suction device 15, and a feed roll 16. The table 12 allows a large number of corrugated fiberboards S to be stacked and placed thereon and is supported so as to be movable up and down. The front stop 13 can position the front end positions of the corrugated fiberboards S stacked on the table 12, and a gap through which one corrugated fiberboard S can pass is secured between a lower end portion of the front stop 13 and the table 12. A plurality of feed rollers 14 are disposed corresponding to the table 12 in the transfer direction D of the corrugated fiberboard S and can send forward the corrugated fiberboard S at the lowermost position among the stacked corrugated fiberboards S when the table 12 has been moved down. The suction device 15 sucks the stacked corrugated fiberboards S downward, that is, toward the table 12 side or the feed roller 14 side. The feed roll 16 can supply the corrugated fiberboard S sent by the feed roller 14 to the printing section 21.

The printing section 21 is for performing multi-color printing (in this embodiment, four-color printing) on the surface of the corrugated fiberboard S. In the printing section 21, four printing units 21A, 21B, 21C, and 21D and one varnish application unit 21E are disposed in series, printing is performed on the surface of the corrugated fiberboard S by using four ink colors, and varnish can be applied thereon. The printing units 21A, 21B, 21C, and 21D and the varnish application unit 21E are configured in substantially the same manner, and each of the units has a printing cylinder 22, an ink supply roll (an anilox roll) 23, an ink chamber 24, and an impression roll 25. The printing cylinder 22 has a printing plate 26 mounted on an outer peripheral portion thereof and is rotatably provided. In the case of the varnish application unit 21E, the printing cylinder 22 is a coater cylinder, and the ink supply roll (the anilox roll) 23 is a roller with a coater. The ink supply roll 23 is disposed in contact with the printing plate 26 in the vicinity of the printing cylinder 22 and is rotatably provided. The ink chamber 24 stores water-based ink (or water-based varnish) as water-based paint and is provided in the vicinity of the ink supply roll 23. The impression roll 25 nips the corrugated fiberboard S between itself and the printing cylinder 22 to convey the corrugated fiberboard S while applying a predetermined printing pressure thereto, and is rotatably provided to face the lower side of the printing cylinder 22.

Further, a drying unit (a sheet drying device) 21F is disposed further on the downstream side than the varnish application unit 21E of the printing section 21. Although will be described later, the drying unit 21F is for drying the water-based ink or the water-based varnish on the corrugated fiberboard S which is conveyed, by using a heating lamp and air.

The slotter creaser section 31 is for carrying out creasing line processing, cutting processing, grooving processing, and gluing margin strip processing on the corrugated fiberboard S by using a slotter device. The slotter creaser section 31 has a first creasing line roll 32, a second creasing line roll 33, a first slotter head 34, a second slotter head 35, and a slitter head 36. The first creasing line roll 32 and the second creasing line roll 33 are for carrying out the creasing line processing on the back surface (lower surface) of the corrugated fiberboard S. The first slotter head 34 and the second slotter head 35 are for performing the grooving processing at a predetermined position in the corrugated fiberboard S and also performing the gluing margin strip processing. The slitter head 36 is provided adjacent to the second slotter head 35 and cuts end portions in a width direction of the corrugated fiberboard S.

The die-cut section 41 is for carrying out punching processing of a hand hole or the like on the corrugated fiberboard S. The die-cut section 41 has a pair of upper and lower feed rolls 42, an anvil cylinder 43, and a knife cylinder 44. The feed rolls 42 nip the corrugated fiberboard S from above and below to convey it and is rotatably provided. The anvil cylinder 43 and the knife cylinder 44 are each formed in a circular shape and can be synchronously rotated by a drive device (not shown). The anvil cylinder 43 has an anvil formed on an outer peripheral portion thereof, while the knife cylinder 44 has a head and a die formed at predetermined positions on an outer peripheral portion thereof.

The speed-increasing section 51 is for increasing the speed of the cut corrugated fiberboard S to secure a predetermined conveyance interval between the corrugated fiberboards S which are conveyed. The speed-increasing section 51 has a pair of upper and lower conveyance belts 52 and 53. The conveyance belts 52 and 53 nips the corrugated fiberboard S from above and below to convey it and can be synchronously rotated by a drive device (not shown). The conveying speed of the corrugated fiberboard S in the speed-increasing section 51 is set to a speed higher than the conveying speed of the corrugated fiberboard S to the die-cut section 41.

The folding section 61 is for folding the corrugated fiberboard S while moving it in the transfer direction D and joining both end portions in the width direction to form a flat corrugated box B. The folding section 61 has an upper conveyance belt 62, lower conveyance belts 63 and 64, and a sheet folding device (a folder gluer) 65. The upper conveyance belt 62 and the lower conveyance belts 63 and 64 nip the corrugated fiberboard S and the corrugated box B from above and below to convey them. Although will be described later, the sheet folding device 65 is for folding the respective end portions in the width direction of the corrugated fiberboard S while bending them downward.

Further, the folding section 61 is provided with a gluing device 66. The gluing device 66 has a glue gun and can perform glue application at a predetermined position on the corrugated fiberboard S by discharging a glue at a predetermined timing.

The counter-ejector section 71 is for stacking the corrugated boxes B while counting them, and then sorting them into a predetermined number of batches, and discharging them. The counter-ejector section 71 has a hopper device 72. The hopper device 72 has a liftable elevator 73 on which the corrugated boxes B are stacked, and the elevator 73 is provided with a front stopper and a corner guard. A discharge conveyor 74 is provided below the hopper device 72.

Here, an operation of making the corrugated box B from the corrugated fiberboard S in the box making machine 10 of this embodiment described above will be described. The box making machine 10 of this embodiment is for making the corrugated box B by performing printing, creasing line processing, grooving processing, gluing margin strip processing, and punching processing on the corrugated fiberboard S and then folding it.

The corrugated fiberboard S is formed by pasting a corrugated medium between a bottom liner and a top liner. In a previous process of the box making machine 10, two folding lines are formed in the corrugated fiberboard S. The folding lines are for folding flaps when assembling the corrugated box B made in the box making machine 10 later. The corrugated fiberboards S are stacked on the table 12 of the sheet feeding section 11, as shown in FIG. 1.

In the sheet feeding section 11, the large number of corrugated fiberboards S stacked on the table 12 are first positioned by the front stop 13, and then the table 12 is moved down, whereby the corrugated fiberboard S at the lowermost position is sent out by the plurality of feed rollers 14. Then, the corrugated fiberboard S is supplied to the printing section 21 at a predetermined constant speed by the pair of feed rolls 16.

In the printing section 21, in each of the printing units 21A, 21B, 21C, and 21D, ink is supplied from the ink chamber 24 to the surface of the ink supply roll 23, and if the printing cylinder 22 and the ink supply roll 23 rotate, the ink on the surface of the ink supply roll 23 is transferred to the printing plate 26. Then, if the corrugated fiberboard S is conveyed between the printing cylinder 22 and the impression roll 25, the corrugated fiberboard S is nipped by the printing plate 26 and the impression roll 25, and printing pressure is applied to the corrugated fiberboard S, so that printing is carried out on the surface thereof. Further, in the varnish application unit 21E, varnish is likewise applied to the surface of the corrugated fiberboard S. Then, in the drying unit 21F, incandescent light is irradiated from a heating lamp to the water-based ink or the water-based varnish on the corrugated fiberboard S which is conveyed, and air is blown to reduce the moisture of the water-based ink or the water-based varnish, whereby the water-based ink or the water-based varnish is dried. The printed and dried corrugated fiberboard S is conveyed to the slotter creaser section 31 by the feed roll.

In the slotter creaser section 31, first, when the corrugated fiberboard S passes through the first creasing line roll 32, a creasing line is formed on the back surface (top liner) side of the corrugated fiberboard S. Further, when the corrugated fiberboard S passes through the second creasing line roll 33, a creasing line is formed on the back surface (top liner) side of the corrugated fiberboard S.

Next, when the corrugated fiberboard S on which the creasing lines are formed passes through the first and second slotter heads 34 and 35, grooves are formed at the positions of the creasing lines. At this time, an end portion is cut at the position of each of the creasing lines, so that a gluing margin strip is formed. Further, when the corrugated fiberboard S passes through the slitter head 36, an end portion is cut at a cutting position. For this reason, the corrugated fiberboard S is composed of four sheet pieces with the creasing lines (grooves) as boundaries.

In the die-cut section 41, when the corrugated fiberboard S passes between the anvil cylinder 43 and the knife cylinder 44, a hand hole or the like is formed. However, the punching processing of the hand hole or the like is appropriately performed according to the type of the corrugated fiberboard S, and when the hand hole or the like is unnecessary, a knife mounting base (a punching blade) for carrying out the punching processing is removed from the knife cylinder 44, and the corrugated fiberboard S passes between the anvil cylinder 43 and the knife cylinder 44 which rotate. Then, the corrugated fiberboard S with the hand hole or the like formed therein is conveyed to the speed-increasing section 51.

In the speed-increasing section 51, the corrugated fiberboard S is conveyed while being nipped by the upper and lower conveyance belts 52 and 53. At this time, the corrugated fiberboard S is conveyed at a conveying speed increased from the conveying speed of the die-cut section 41, whereby a predetermined conveyance interval is formed between the corrugated fiberboards S. Thereafter, the corrugated fiberboard S is conveyed to the folding section 61. The speed-increasing section 51 may not be provided. In this case, the corrugated fiberboard S is conveyed from the die-cut section 41 to the folding section 61.

In the folding section 61, the corrugated fiberboard S is folded downward by the sheet folding device 65 with the creasing line as a base point, after the glue is applied to the gluing margin strip by the gluing device 66, while the corrugated fiberboard S is moved in the transfer direction D by the upper conveyance belt 62 and the lower conveyance belts 63 and 64. If the folding progresses to nearly 180 degrees, a folding force becomes stronger, and thus the gluing margin strip and the end portion of the corrugated fiberboard S are pressed against each other and brought into close contact with each other, and both end portions of the corrugated fiberboard S are joined to each other to form the corrugated box B. Then, the corrugated box B is conveyed to the counter-ejector section 71.

In the counter-ejector section 71, the corrugated box B is sent to the hopper device 72, and a leading end portion in the transfer direction D of the corrugated box B comes into contact with the front stopper and is stacked on the elevator 73 in a state of being trimmed by the corner guard. Then, if a predetermined number of corrugated boxes B are stacked on the elevator 73, the elevator 73 is moved down, and a predetermined number of corrugated boxes B are discharged as one batch by the discharge conveyor 74 and sent to a post-process of the box making machine 10.

Figure 2:
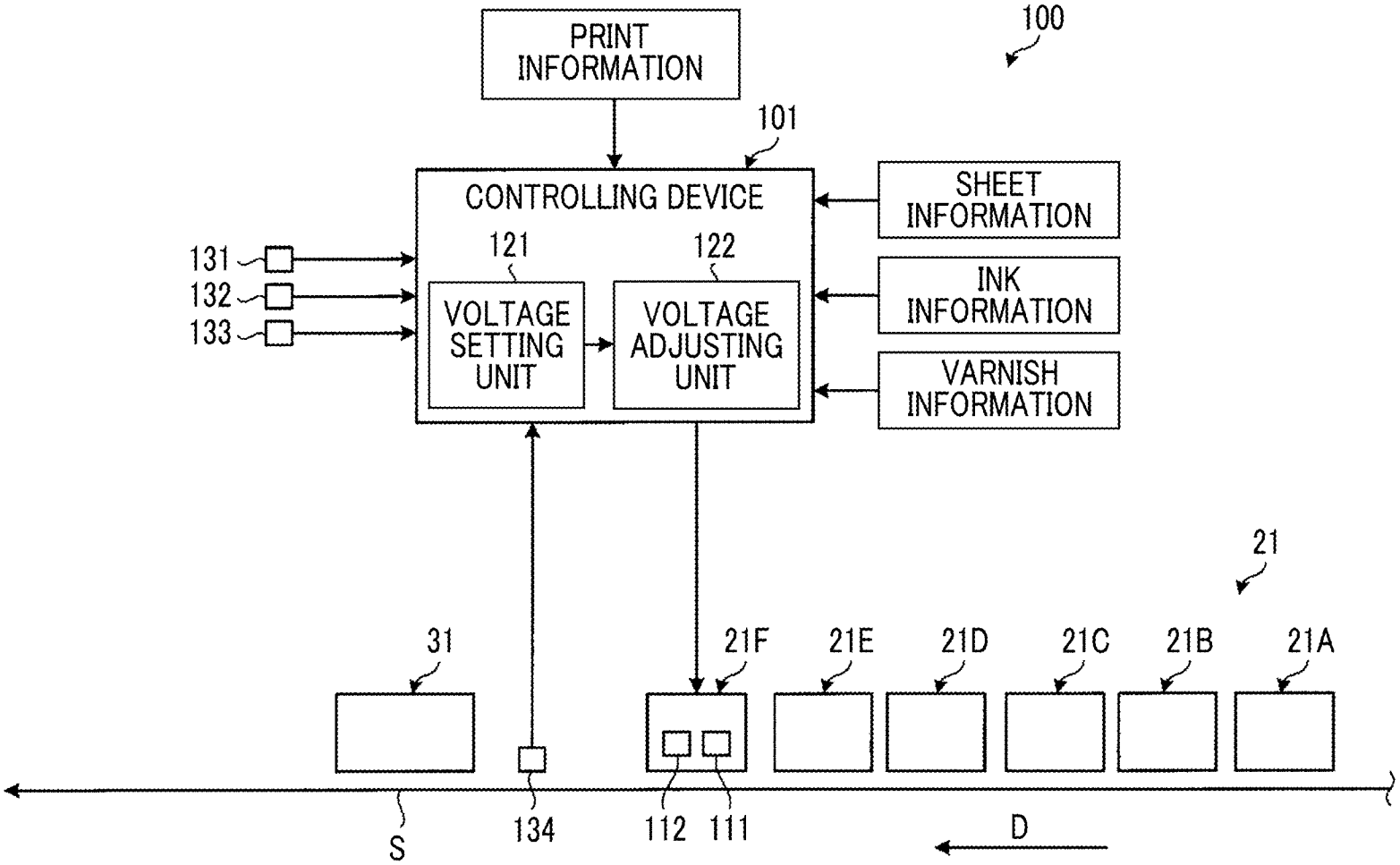
FIG. 2 is a block configuration diagram showing a sheet drying device of the present embodiment.

Here, the drying unit 21F will be described in detail. FIG. 2 is a block configuration diagram showing the sheet drying device of this embodiment, and FIG. 3 is a schematic diagram showing the relationship between an ink application state and a heating state of the heating lamp.

In this embodiment, as shown in FIG. 2, a sheet drying device 100 includes the drying unit 21F described above and a controlling device 101. The drying unit 21F is disposed to face a printing surface of the corrugated fiberboard S which is conveyed, and is composed of a heating lamp 111 and an air supply device 112. The controlling device 101 controls the drying unit 21F and is provided with a voltage adjusting unit 122 and a voltage setting unit 121.

Figure 3:
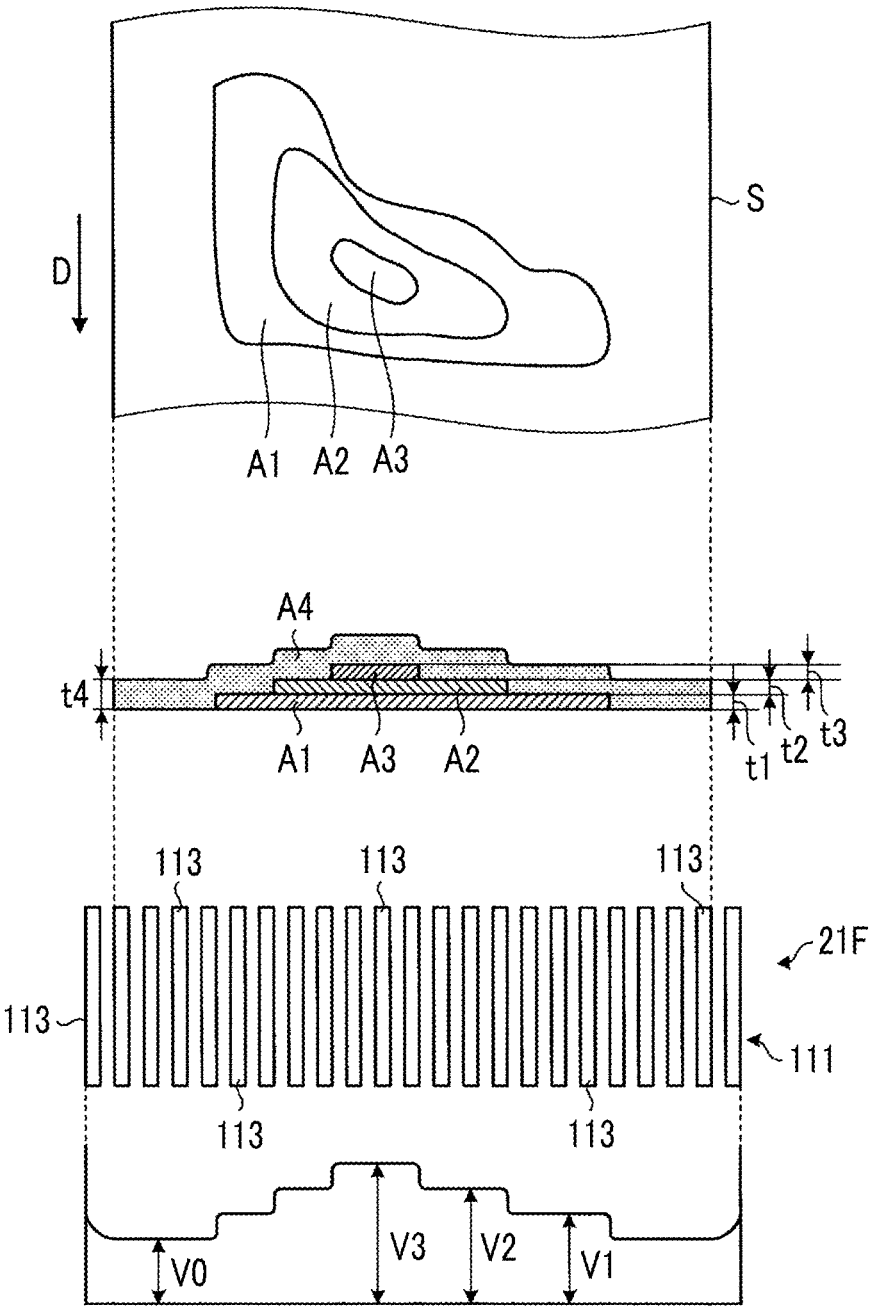
FIG. 3 is a schematic diagram showing a relationship between an ink application state and a heating state of a heating lamp.

The heating lamp 111 is composed of a plurality of lamp bodies 113 which extend along the transfer direction D of the corrugated fiberboard S and are disposed at predetermined intervals in a direction orthogonal to (crossing) the transfer direction D to forms a rod shape, as shown in FIG. 3. The heating lamp 111 is, for example, an incandescent lamp, and an infrared irradiation lamp such as a halogen lamp, a carbon heater, or a ceramic heater, a krypton light bulb, a general light bulb, or the like is used. The plurality of lamp bodies 113 are disposed in parallel to the transfer direction D of the corrugated fiberboard S. However, the lamp bodies 113 may be disposed to be inclined at a predetermined angle (for example, an angle in a range of 5 to 10 degrees). The air supply device 112 is configured with a plurality of air injection ports (not shown) each provided between the plurality of lamp bodies 113.

For this reason, as shown in FIG. 2, in the drying unit 21F, heat generation light is irradiated from each of the lamp bodies 113 of the heating lamp 111 to the water-based ink or the water-based varnish on the corrugated fiberboard S which is conveyed, and air is injected from each of the air injection ports of the air supply device 112. Then, the water-based ink or the water-based varnish on the corrugated fiberboard S receive incandescent light or air, so that the moisture evaporates, and thus the water-based ink or the water-based varnish is dried.

In the heating lamp 111 (the lamp body 113) of the drying unit 21F, a rated voltage and a rated current are set. The rated voltage and the rated current are set according to the maximum film thickness (maximum application amount) of the ink and the varnish which are applied to the corrugated fiberboard S. When the amount of moisture (water content) of the ink or the varnish which is used is set to a predetermined value, an applied part where the ink by each of the printing units 21A, 21B, 21C, and 21D and the varnish by the varnish application unit 21E overlap each other forms the maximum film thickness of the ink and varnish. When the corrugated fiberboard S travels at a predetermined conveying speed, the heating lamp 111 (the lamp body 113) capable of reducing the moisture of the ink and varnish of the maximum film thickness to a predetermined moisture amount is applied.

The voltage adjusting unit 122 is for adjusting the voltage of electric power which is supplied to the heating lamp 111. The voltage setting unit 121 is for setting a working voltage of the heating lamp 111 by setting a voltage that is lower than the rated voltage of the heating lamp 111 by a predetermined value set in advance as a reference voltage and increasing or decreasing the reference voltage according to the film thickness (the application amount) of the water-based paint (ink or varnish) on the corrugated fiberboard S. The controlling device (control unit) 101 changes the voltage of the heating lamp 111 to the working voltage set by the voltage setting unit 121 by using the voltage adjusting unit 122. Here, the application amount of the water-based paint is described as the film thickness of the water-based paint. However, the application amount of the water-based paint is an application amount per unit area and is a meaning substantially equivalent to the film thickness of the water-based paint.

In this case, the reference voltage is a voltage between 75% of the rated voltage of the heating lamp 111 and 85% of the rated voltage of the heating lamp 111, and 80% of the rated voltage of the heating lamp 111 is optimum.

Further, the voltage setting unit 121 sets the working voltage by increasing or decreasing the reference voltage, based on print information. Here, the print information is pattern information to be printed and is an overlapping state of each ink and varnish in the width direction of the corrugated fiberboard S. The voltage setting unit 121 sets the working voltage by increasing the reference voltage as the overlapping amount of each ink and the water-based varnish on the corrugated fiberboard S increases.

Further, the print information is the conveying speed of the corrugated fiberboard S, and the voltage setting unit 121 increases the working voltage as the conveying speed of the corrugated fiberboard S increases. Further, the controlling device 101 receives sheet information, ink information, and varnish information. The voltage setting unit 121 increases the working voltage as the material of the corrugated fiberboard S is hard to be dried (low in water absorbency), based on the sheet information, and increases the working voltage as the amount of moisture of the corrugated fiberboard S is higher, based on the ink information and the varnish information.

A temperature sensor 131 which measures the atmosphere temperature of the drying unit 21F, a humidity sensor 132 which measures the atmosphere humidity of the drying unit 21F, and a temperature sensor 133 which measures the temperature of the corrugated fiberboard S are provided, and each measurement result is input to the controlling device 101. The voltage setting unit 121 increases the working voltage as the atmosphere temperature is lower, increases the working voltage as the atmosphere humidity is higher, and increases the working voltage as the temperature of the corrugated fiberboard S is lower.

Further, a moisture sensor 134 which measures the amount of moisture of the ink and varnish on the corrugated fiberboard S after drying is provided further on the downstream side than the drying unit 21F and further on the upstream side than the slotter creaser section 31, and the measurement result is input to the controlling device 101. The voltage setting unit 121 increases the working voltage when the measurement value of the moisture sensor, that is, the amount of moisture of the ink and varnish on the corrugated fiberboard S after drying is higher than a determination value set in advance.

Specifically, as shown in FIGS. 2 and 3, when three ink application areas A1, A2, and A3 exist on the printing surface of the corrugated fiberboard S and one varnish application area A4 exists over the entire area, film thicknesses t1, t2, and t3 of the three ink application areas A1, A2, and A3 and a film thickness t4 of the one varnish application area A4 are set in the width direction of the corrugated fiberboard S. At this time, the voltage setting unit 121 sets the working voltage for each of the plurality of lamp bodies 113 according to the film thicknesses of the ink and the varnish on the corrugated fiberboard S.

On the printing surface of the corrugated fiberboard S, the film thickness t4 of the varnish, in which there is no ink application area A1, A2, or A3 and there is only the varnish application area A4, is an area with the thinnest film thickness, and the area is set to a working voltage V0. Further, the area of the varnish film thickness t1+t4, in which there are the ink application area A1 and the varnish application area A4, is set to a working voltage V1, the area of the varnish film thickness t1+t2+t4, in which there are the ink application areas A1 and A2 and the varnish application area A4, is set to a working voltage V2, and the area of the varnish film thickness t1+t2+t3+t4, in which there are the ink application areas A1, A2, and A3 and the varnish application area A4, is set to a working voltage V3. Here, the working voltage V0 is set as the reference voltage, and the magnitude relationship between the working voltages V0, V1, V2, and V3 is a relationship of V0<V1<V2<V3.

In the corrugated fiberboard S, each end portion in the width direction is not easily heated, and therefore, it is desirable to increase a working voltage at each end portion in the width direction with respect to the working voltage (reference voltage) V0. Further, the temperature of the printing section 21 itself is low at the time of the beginning of printing, and therefore, it is desirable to increase the working voltage at the time of the beginning of printing.

Figure 4:
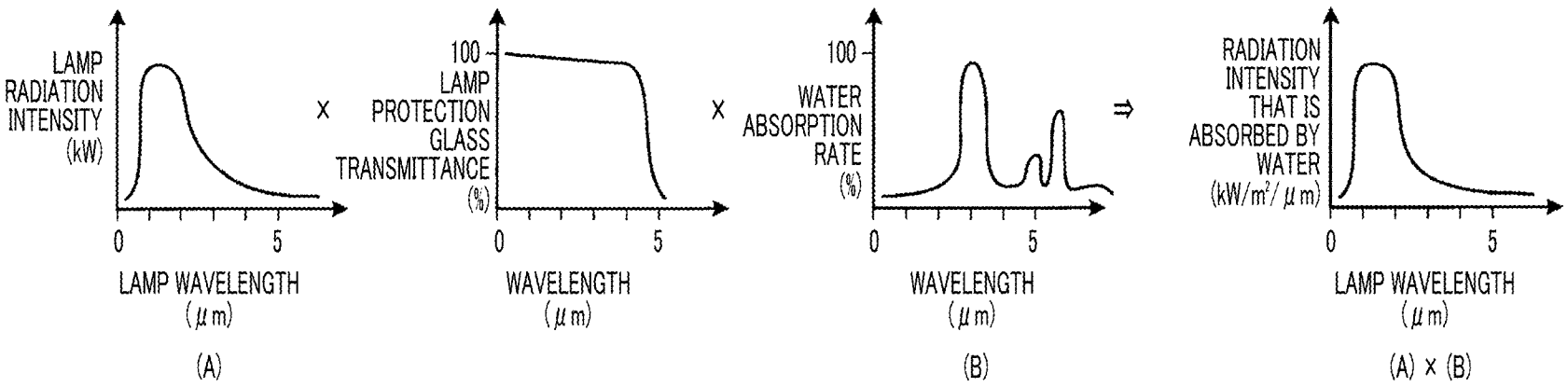
FIG. 4 is a graph showing a lamp wavelength required for drying of ink and varnish.

Here, the reason why it is preferable to set the working voltage for each of the lamp bodies 113 according to the film thicknesses of the ink and the varnish on the corrugated fiberboard S will be described. FIG. 4 is a graph showing a lamp wavelength required for the drying of the ink and the varnish, and FIG. 5 is a graph showing a change in lamp wavelength due to a decrease in lamp radiation intensity.

As shown in FIG. 4, for example, a halogen lamp as the heating lamp 111 has a peak at 1.1 μm (A). Lamp protection glass transmits almost 100%, and therefore, intensity does not decrease here. The intrinsic absorption wavelength of water is mainly 3 μm (B), and the intensity which is absorbed by water is determined by (A)×(B).

Figure 5:
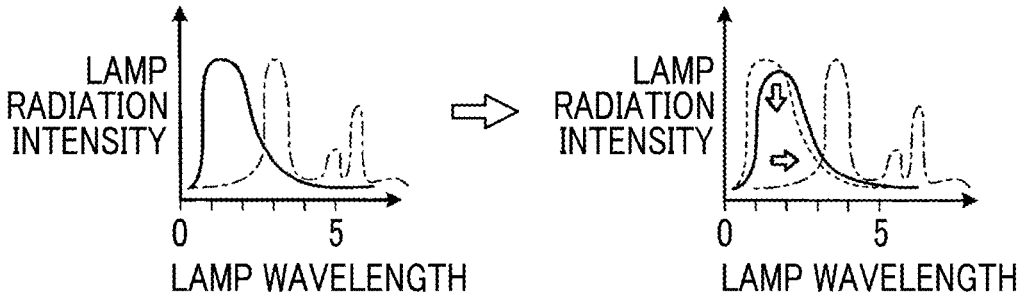
FIG. 5 is a graph showing a change in lamp wavelength due to a decrease in lamp radiation intensity.

On the other hand, FIG. 5 shows the relationship between the lamp wavelength, the lamp radiation intensity, and an absorption rate of water in consideration of only the lamp radiation intensity and the inhalation rate of water except for the transmittance (%) of the lamp protection glass, because in the halogen lamp as the heating lamp 111, the lamp wavelength is almost constant in a range of 0 μm to 4.0 μm. In FIG. 5, a solid line and a dotted line indicate the lamp radiation intensity, and a dot-and-dash line indicates the absorption rate of water. When the voltage of the heating lamp 111 (the lamp body 113) is set to a rated voltage (100%), the lamp wavelength at which the lamp radiation intensity becomes the maximum and the lamp wavelength at which the absorption rate of water becomes the maximum deviate from each other. Then, if the voltage of the heating lamp 111 is lowered to 80% of the rated voltage, although the lamp radiation intensity decreases, the lamp wavelength at which the lamp radiation intensity becomes the maximum shifts to the increase side, and the peak wavelength of the lamp comes close to the absorption rate of water. This is based on the Planck's law and is a formula relating to the spectral radiance of an electromagnetic wave which is radiated (emitted) from a black body in physics, or the wavelength distribution of energy density. As a result, even if the working voltage of the heating lamp 111 is lowered to 80% of the rated voltage, the lamp wavelength at which the lamp radiation intensity becomes the maximum comes close to the lamp wavelength at which the absorption rate of water becomes the maximum, and therefore, it can be seen that a large decrease in drying performance is suppressed.

Figure 6:
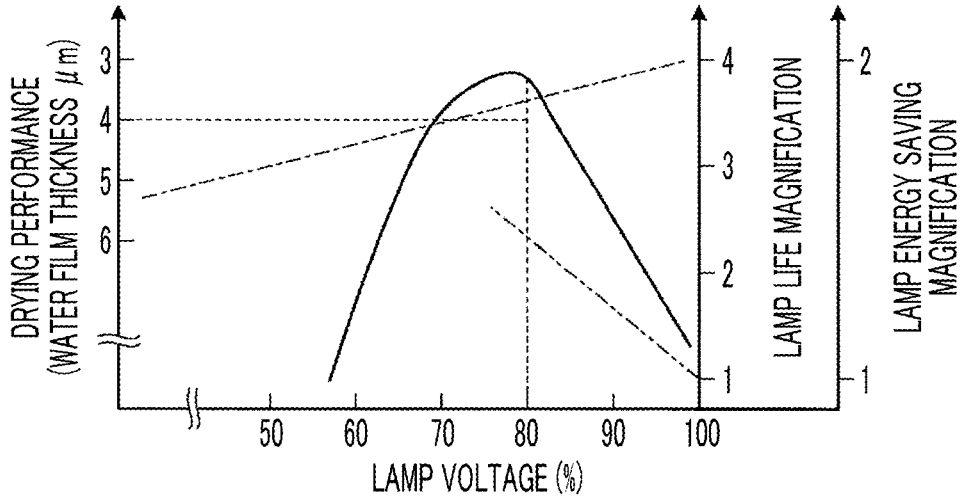
FIG. 6 is a graph showing drying performance, lamp energy saving magnification, and lamp life magnification with respect to a lamp voltage.

FIG. 6 is a graph showing drying performance, lamp energy saving magnification, and lamp life magnification with respect to a lamp voltage. In FIG. 6, a dot-and-dash line indicates the drying performance (water film thickness) with respect to the lamp voltage, a two-dot chain line indicates the lamp energy saving magnification, and a solid line indicates the lamp life magnification. The operating condition in this case is to travel the corrugated fiberboard S at a conveying speed of 400 BPM and carry out four-color printing processing and varnish application processing.

As shown in FIG. 6, the drying performance indicated by the dot-and-dash line tends to decrease according to a decrease in lamp voltage. However, the limit value of the water film thickness remaining in the ink or the varnish is, for example, 4 μm, and the lamp voltage is secured as a voltage of 70% or more of the rated voltage. The lamp energy saving magnification indicated by the two-dot chain line tends to be improved according to a decrease in lamp voltage. However, if the lamp voltage becomes equal to or less than 70% of the rated voltage, the lamp does not function as a lamp for drying. Then, the lamp life magnification indicated by the solid line tends to be improved according to a decrease in lamp voltage. However, the lamp voltage decreases with 80% of the rated voltage as the peak. From this experimental results, it can be seen that, if only the lamp life magnification is taken into account, it is preferable to set the working voltage of the heating lamp 111 to 80% of the rated voltage.

Figures 7, 8:
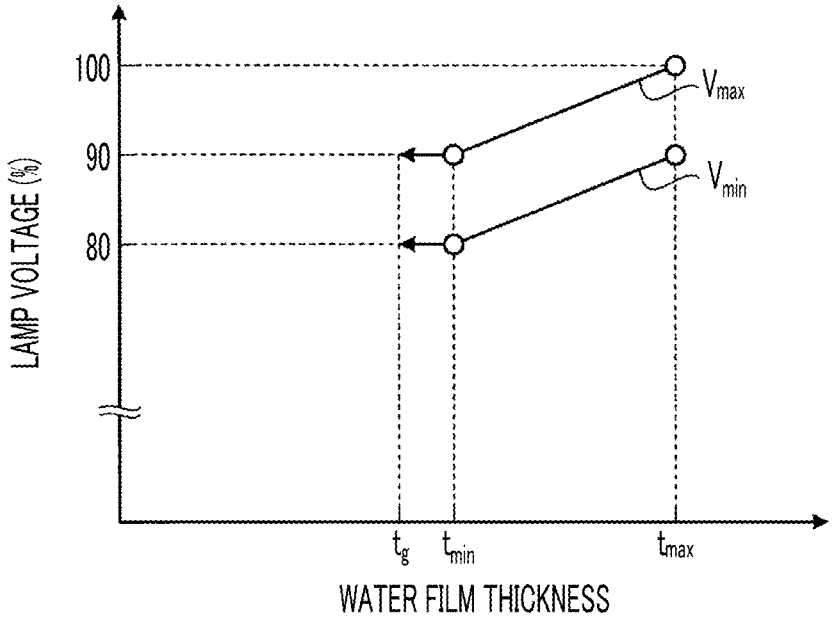
FIG. 7 is a graph showing a required lamp voltage with respect to a water film thickness.
FIG. 8 is a table showing the comparison of the operational effects of a conventional sheet drying device and the sheet drying device of the present embodiment.

FIG. 7 is a graph showing a required lamp voltage with respect to a water film thickness. As shown in FIG. 7, when the conveying speed of the corrugated fiberboard S is a minimum conveying speed $V_{min}$ and the water film thickness becomes a maximum film thickness $t_{max}$ by carrying out varnish application in four-color printing, the working voltage of the heating lamp 111 is set to 90% of the rated voltage, and the working voltage of the heating lamp 111 is lowered to the side of 80% of the rated voltage as the water film thickness shifts to a minimum film thickness $t_{min}$. When the working voltage of the heating lamp 111 is 80% of the rated voltage, the water film thickness becomes equal to or less than a limit film thickness $t_g$ (for example, 4 μm) of the remaining water film thickness. Further, when the conveying speed of the corrugated fiberboard S is a maximum conveying speed $V_{max}$ and the water film thickness becomes the maximum film thickness $t_{max}$ by carrying out varnish application in four-color printing, the working voltage of the heating lamp 111 is set to 100% of the rated voltage, and the working voltage of the heating lamp 111 is lowered to the side of 90% of the rated voltage as the water film thickness shifts to the minimum film thickness $t_{min}$. When the working voltage of the heating lamp 111 is 90% of the rated voltage, the water film thickness becomes equal to or less than the limit film thickness $t_g$ (for example, 4 μm) of the remaining water film thickness. The working voltage of the heating lamp 111 is changed according to the conveying speed of the corrugated fiberboard S.

FIG. 8 is a table showing the comparison of the operational effects of the conventional sheet drying device and the sheet drying device of this embodiment.

As shown in FIG. 8, as in the conventional sheet drying device, if the working voltage of the heating lamp 111 is set to 100% of the rated voltage and an operation of drying the ink or the varnish is carried out, electric power density becomes 70 kW/m$^2$, a color temperature becomes 2500 k (Kelvin), a main wavelength becomes 1.1 μm, a moisture absorption rate becomes 13.3%, and moisture heat input becomes 9.3 kW/m$^2$, and the lamp life magnification at this time is set to be 1 time. Then, as in this embodiment, if the working voltage of the heating lamp 111 is set to 80% of the rated voltage and an operation of drying the ink or the varnish is carried out, the electric power density becomes 50 kW/m$^2$, the color temperature becomes 2250 k (Kelvin), the main wavelength becomes 1.3 μm, the moisture absorption rate becomes 16.4%, and the moisture heat input becomes 8.2 kW/m$^2$, and the lamp life magnification at this time is quadrupled. Here, the electric power decreases to 50 kW/m$^2$÷70 kW/m$^2$=71%. However, a decrease in heat input to water is suppressed to 8.2 kW/m$^2$÷9.3 kW/m$^2$=88%, and the lamp life magnification can be quadrupled.

In this manner, the sheet drying device of this embodiment includes the heating lamp 111 which is disposed to face the printing surface of the corrugated fiberboard S, the voltage adjusting unit 122 which adjusts the voltage of electric power which is supplied to the heating lamp 111, the voltage setting unit 121 which sets the working voltage of the heating lamp 111 by setting a voltage which is lower than the rated voltage of the heating lamp 111 by a predetermined value set in advance as a reference voltage and increasing or decreasing the reference voltage according to the film thickness (application amount) of the water-based paint on the corrugated fiberboard S, and the controlling device 101 which changes the voltage of the heating lamp 111 to the working voltage set by the voltage setting unit 121 by using the voltage adjusting unit 122.

Therefore, the working voltage of the heating lamp 111 is set by setting a voltage lower than the rated voltage of the heating lamp 111 as a reference voltage and increasing or decreasing the reference voltage according to the film thickness of the water-based paint on the corrugated fiberboard S, and the set working voltage is applied to the heating lamp 111 to light the heating lamp 111, whereby the water-based paint on the corrugated fiberboard S is dried. For this reason, the water-based paint is dried with the minimum amount of energy, and thus energy saving of the heating lamp 111 can be achieved while maintaining the drying performance of the water-based paint and prolongation of the life of the heating lamp 111 can be achieved.

In the sheet drying device of this embodiment, the reference voltage is set to a voltage between 75% of the rated voltage of the heating lamp 111 and 85% of the rated voltage of the heating lamp 111. Therefore, energy saving of the heating lamp 111 can be achieved while maintaining the drying performance of the water-based paint and prolongation of the life of the heating lamp 111 can be achieved.

In the sheet drying device of this embodiment, the water-based paint is water-based ink of different colors and water-based varnish, and the voltage setting unit 121 sets the working voltage by increasing the reference voltage as an overlapping amount of the water-based ink and the water-based varnish on the corrugated fiberboard S increases. Therefore, even in an area where the water-based ink and the water-based varnish overlap each other, sufficient drying performance can be secured. Further, even in a case where the water-based varnish is not applied, sufficient drying performance can be secured even in an area where different types of water-based ink overlap each other or an area where the film thickness of ink of a single color is thick.

In the sheet drying device of this embodiment, the voltage setting unit 121 sets the working voltage by increasing or decreasing the reference voltage, based on print information. Therefore, the working voltage of the heating lamp 111 according to a print pattern can be set, and drying unevenness can be suppressed.

In the sheet drying device of this embodiment, the voltage setting unit 121 increases the working voltage as the conveying speed of the corrugated fiberboard S as the print information increases. Therefore, insufficient drying due to an increase in the conveying speed of the corrugated fiberboard S can be suppressed.

In the sheet drying device of this embodiment, a moisture sensor 134 which measures the amount of moisture of the water-based paint on the corrugated fiberboard S after drying is provided, and the voltage setting unit 121 increases the working voltage when the measurement value of the moisture sensor 134 is higher than a determination value set in advance. Therefore, even if variation in drying of the water-based paint occurs, the working voltage can be increased early to increase the heating amount, and therefore, stable drying performance can be maintained.

In the sheet drying device of this embodiment, as the heating lamp 111, the plurality of lamp bodies 113 which extend in the transfer direction D of the corrugated fiberboard S and are disposed at predetermined intervals in a direction crossing the transfer direction D of the corrugated fiberboard S are provided, and the voltage setting unit 121 sets the working voltage for each of the plurality of lamp bodies 113 according to the film thickness of the water-based paint on the corrugated fiberboard S. Therefore, even if the ink film thickness changes in the width direction of the corrugated fiberboard S, stable drying performance can be maintained.

Further, the sheet drying method of this embodiment includes a step of setting a voltage which is lower than the rated voltage of the heating lamp 111 by a predetermined value set in advance as a reference voltage, and a step of setting the working voltage of the heating lamp 111 by increasing or decreasing the reference voltage according to the film thickness (application amount) of the water-based paint on the corrugated fiberboard S. Therefore, energy saving of the heating lamp 111 can be achieved while maintaining the drying performance of the water-based paint and prolongation of the life of the heating lamp 111 can be achieved.

The sheet drying method according to the present invention is not limited to this method. For example, the sheet drying method may include a step of setting the rated voltage of the heating lamp 111 according to the maximum film thickness of the water-based paint on the corrugated fiberboard S, and a step of adjusting the rated voltage according to the film thickness (application amount) of the water-based paint in a range between the rated voltage and a voltage of 75% of the rated voltage when the film thickness of the water-based paint on the corrugated fiberboard S decreases below the maximum film thickness. Even in this case, energy saving of the heating lamp 111 can be achieved while maintaining the drying performance of the water-based paint, and prolongation of the life of the heating lamp 111 can be achieved.

Further, the box making machine of this embodiment includes the sheet feeding section 11, the printing section 21, the drying unit 21F, the slotter creaser section 31, the die-cut section 41, the speed-increasing section 51, the folding section 61, and the counter-ejector section 71. Therefore, printing is performed on the corrugated fiberboard S from the sheet feeding section 11 in the printing section 21, creasing line processing and grooving processing are performed in the slotter creaser section 31, and in the folding section 61, folding is performed and the end portions are joined to each other, so that the corrugated box B is formed, and the corrugated boxes B are stacked while being counted in the counter-ejector section 71. At this time, in the drying unit 21F, the water-based paint on the corrugated fiberboard S is dried by setting a voltage lower than the rated voltage of the heating lamp 111 as a reference voltage, setting the working voltage of the heating lamp 111 by increasing or decreasing the reference voltage according to the film thickness of the water-based paint on the corrugated fiberboard S, and applying the set working voltage to the heating lamp 111 to light the heating lamp 111. For this reason, energy saving of the heating lamp 111 can be achieved while maintaining the drying performance of the water-based paint, and prolongation of the life of the heating lamp 111 can be achieved.

In the embodiment described above, the voltage setting unit 121 sets the working voltage for each of the plurality of lamp bodies 113 disposed at predetermined intervals in the width direction according to the film thickness of the water-based paint on the corrugated fiberboard S. However, the plurality of lamp bodies 113 may be disposed at predetermined intervals in the transfer direction, and the voltage setting unit 121 may set the working voltage for each of the lamp bodies 113 in the transfer direction according to the film thickness of the water-based paint on the corrugated fiberboard S.

In the embodiment described above, the voltage of the electric power which is supplied to the heating lamp 111 is adjusted according to the film thickness of the water-based paint. However, instead of the heating lamp, a hot air fan may be provided and a heat source or the power source voltage of the hot air fan may be adjusted. Further, instead of the heating lamp, the amount of current of an infrared LED lamp may be controlled according to the film thickness (the application amount).

Further, in the embodiment described above, the working voltage of the heating lamp is set by increasing or decreasing the reference voltage according to the film thickness (application amount) of the water-based paint on the sheet. However, the working voltage of the heating lamp may be set by increasing or decreasing the reference voltage according to the number of rotations of a roller with a coater.

Further, in the embodiment described above, the box making machine 10 is composed of the sheet feeding section 11, the printing section 21, the slotter creaser section 31, the die-cut section 41, the speed-increasing section 51, the folding section 61, and the counter-ejector section 71. However, there is no limitation to this configuration. The box making machine 10 may be composed of only the sheet feeding section 11, the printing section 21, and the folding section 61.

Further, in the embodiment described above, the sheet drying device according to the present invention has been described as being applied to the box making machine 10. However, the sheet drying device may be applied to a web offset press for newspaper, a commercial web offset press, an offset sheet-fed press, and the like.

REFERENCE SIGNS LIST

11: sheet feeding section
21: printing section
21A, 21B, 21C, 21D: printing unit
21E: varnish application unit
21F: drying unit
31: slotter creaser section
41: die-cut section
42: feed roll
43: anvil cylinder
44: knife cylinder
51: speed-increasing section
61: folding section
65: sheet folding device
71: counter-ejector section
100: sheet drying device
101: controlling device
111: heating lamp
112: air supply device
113: lamp body
121: voltage setting unit
122: voltage adjusting unit
D: transfer direction
S: corrugated fiberboard
B: corrugated box

The invention claimed is:

1. A sheet drying device that dries water-based paint on a sheet that is conveyed, the sheet drying device comprising:
- a heating lamp configured to be disposed to face a printing surface of the sheet;
- a voltage adjusting unit configured to adjust a voltage of electric power to be supplied to the heating lamp;
- a voltage setting unit configured to set a working voltage of the heating lamp by setting a voltage that is lower than a rated voltage of the heating lamp by a predetermined value set in advance as a reference voltage and increasing or decreasing the reference voltage according to a film thickness of the water-based paint on the sheet, the rated voltage of the heating lamp being set according to a maximum film thickness of the water-based paint on the sheet;
- a control unit configured to change a voltage of the heating lamp to the working voltage set by the voltage setting unit by using the voltage adjusting unit.

2. The sheet drying device according to claim 1, wherein the reference voltage is set to a voltage between 75% of the rated voltage of the heating lamp and 85% of the rated voltage of the heating lamp.

3. The sheet drying device according to claim 1, wherein the water-based paint is water-based ink of at least one or more colors or water-based varnish, and the voltage setting unit is configured to set the working voltage by increasing the reference voltage as an overlapping amount of the water-based paint increases.

4. The sheet drying device according to claim 1, wherein the voltage setting unit is configured to set the working voltage by increasing or decreasing the reference voltage, based on print information.

5. The sheet drying device according to claim 4, wherein the voltage setting unit is configured to increases the working voltage as a conveying speed of the sheet as the print information increases.

6. The sheet drying device according to claim 1, further comprising a moisture sensor configured to measure the amount of moisture of the water-based paint on the sheet after drying, wherein the voltage setting unit is configured to increase the working voltage when a measurement value of the moisture sensor is higher than a determination value set in advance.

7. The sheet drying device according to claim 1, wherein
- the heating lamp includes a plurality of lamp bodies that extend in a transfer direction of the sheet and are disposed at predetermined intervals in a direction crossing the transfer direction of the sheet, and
- the voltage setting unit is configured to set the working voltage for each of the plurality of lamp bodies according to the application amount of the water-based paint on the sheet.

8. A sheet drying method of drying water-based paint on a sheet that is conveyed, by using a heating lamp that is disposed to face the water-based paint on the sheet, the method comprising:
- adjusting a voltage of electric power to be supplied to the heating lamp;
- setting a working voltage of the heating lamp by
  - setting a voltage that is lower than a rated voltage of the heating lamp by a predetermined value set in advance as a reference voltage, and
  - increasing or decreasing the reference voltage according to a film thickness of the water-based paint on the sheet, the rated voltage of the heating lamp being set according to a maximum film thickness of the water-based paint on the sheet; and changing a voltage of the heating lamp to the working voltage.

9. A sheet drying method of drying water-based paint on a sheet that is conveyed, by using a heating lamp that is disposed to face the water-based paint on the sheet, the method comprising:

adjusting a voltage of electric power to be supplied to the heating lamp;

setting a working voltage of the heating lamp by setting a voltage that is lower than a rated voltage of the heating lamp by a predetermined value set in advance as a reference voltage, and increasing or decreasing the reference voltage according to a film thickness of the water-based paint on the sheet;

setting a rated voltage of the heating lamp according to a maximum film thickness of the water-based paint on the sheet; and adjusting the rated voltage according to the film thickness in a range between the rated voltage and a voltage of 75% of the rated voltage when the film thickness of the water-based paint on the sheet decreases below the maximum film thickness.

* * * * *